US006995722B2

(12) United States Patent
Komatsu et al.

(10) Patent No.: US 6,995,722 B2
(45) Date of Patent: Feb. 7, 2006

(54) ON-BOARD ANTENNA

(75) Inventors: Satoru Komatsu, Saitama (JP); Hiroshi Kuribayashi, Saitama (JP); Tomoyuki Fukumaru, Saitama (JP); Hiroshi Iijima, Osaka (JP); Hideaki Oshima, Osaka (JP); Tatsuo Matsushita, Ibaraki (JP)

(73) Assignees: Honda Motor Co., Ltd., Tokyo (JP); Nippon Sheet Glass Company, Ltd., Osaka (JP)

( * ) Notice: Subject to any disclaimer, the term of this patent is extended or adjusted under 35 U.S.C. 154(b) by 41 days.

(21) Appl. No.: 10/743,904

(22) Filed: Dec. 24, 2003

(65) Prior Publication Data

US 2004/0150564 A1 Aug. 5, 2004

(30) Foreign Application Priority Data

Dec. 27, 2002 (JP) ..... P2002-379996

(51) Int. Cl.
*H01Q 1/32* (2006.01)

(52) U.S. Cl. ..... 343/711; 343/700 MS; 343/702; 343/713; 343/767; 343/846

(58) Field of Classification Search ..... 343/711, 343/713, 767, 700 MS, 702, 846
See application file for complete search history.

(56) References Cited

U.S. PATENT DOCUMENTS

| | | | | | |
|---|---|---|---|---|---|
| 3,845,489 | A | * | 10/1974 | Sauer et al. | 343/713 |
| 5,274,391 | A | * | 12/1993 | Connolly | 343/820 |
| 5,300,936 | A | * | 4/1994 | Izadian | 343/700 MS |
| 5,872,546 | A | * | 2/1999 | Ihara et al. | 343/795 |
| 5,936,587 | A | * | 8/1999 | Gudilev et al. | 343/752 |
| 6,097,345 | A | * | 8/2000 | Walton | 343/769 |
| 6,795,023 | B2 | * | 9/2004 | Chen | 343/700 MS |
| 2004/0056811 | A1 | * | 3/2004 | Pakray et al. | 343/713 |

FOREIGN PATENT DOCUMENTS

| | | | |
|---|---|---|---|
| JP | 5-63424 | | 3/1993 |
| JP | 09-181525 | * | 7/1997 |
| JP | 2002-252520 | | 9/2002 |

* cited by examiner

*Primary Examiner*—Shih-Chao Chen
*Assistant Examiner*—Leith A. Al-Nazer
(74) *Attorney, Agent, or Firm*—Arent Fox PLLC

(57) ABSTRACT

An on-board antenna having a grounding conductor provided on a surface of a first dielectric substrate and an antenna element including a first radiation element provided on the surface of the first dielectric substrate and a second radiation element provided on the first radiation element so as to protrude from a surface of the first dielectric substrate and extend in a vertical direction.

8 Claims, 3 Drawing Sheets

ON-BOARD ANTENNA

BACKGROUND OF THE INVENTION

1. Field of the Invention

The present invention relates to an on board antenna.

2. Description of the Related Art

Conventionally, a planar antenna is known which comprises a radiation element provided on the same surface of, for example, an automotive window glass which is located on a passenger compartment side thereof and a substantially annular grounding conductor which surrounds the periphery of an outer edge portion of the radiation element at a position spaced away outwardly from the outer edge portion of the radiation element (for example, refer to Published Japanese Patent JP-A-2002-252520).

In addition, a planar antenna is known which comprises a spacer inclined in such a manner that a normal direction of the planar antenna is closer to verticality than a normal direction of an actual installation position (for example, the automotive-window glass) of the planar antenna in order to improve the receiving sensitivity relative to signals transmitted from, for example, an artificial earth satellite at a relatively high elevation angle (for example, refer to published Japanese patent JP-A-5-63424).

Incidentally, in installing the planer antenna according to the aforesaid conventional example on a vehicle, in the event that the planner antenna is installed on an automotive window glass such as a front windshield or rear window glass, for example, it is desired to prevent the antenna not only from interrupting the vision of occupants of the vehicle but also from deteriorating the external appearance of the vehicle.

However, in the event that the dimensions and layout of the planar antenna are regulated based on the external appearance of the vehicle, for example, there may be caused a risk that attaining desired transmitting and receiving properties is made difficult. In particular, in the event that the planar antenna is provided on the surface of an automotive window glass which is disposed so as to intersect a vertical direction, there is caused a problem that securing desired transmitting and receiving properties relative to vertical polarization is made difficult.

SUMMARY OF THE INVENTION

The present invention was made in view of the situations, and an object thereof is to provide an on-board antenna which can improve the transmitting and receiving properties thereof relative to the vertical polarization while suppressing the deterioration in vehicle installation property thereof.

With a view to solving the problem so as to attain the object, according to a first aspect of the present invention, there is provided an on-board antenna comprising a grounding conductor provided on a surface (for example, a passenger compartment-side inner surface 2A in the embodiment) of a first dielectric substrate (for example, a rear window glass 2 in the embodiment) and an antenna element including a first radiation element (for example, a first radiation conductor 22 in an embodiment) are provided on the surface of the first dielectric substrate and a second radiation element portion (for example, a vertical radiation conductor 23 or a second radiation conductor 23*a* in the embodiment) provided additionally on the first radiation element portion so as to protrude from the surface of the first dielectric substrate and extend substantially in a vertical direction. According to a fifth aspect of the present invention, the second radiation element of the antenna element may be an I-shape.

According to the on-board antenna, in the event that for example, the first dielectric substrate is an automotive window glass, which has a surface which intersects a vertical direction, the sensitivity relative to vertical polarization can be improved by providing the second radiation element which extends substantially in the vertical direction.

According to a second aspect of the present invention, there is provided an on-board antenna as set forth in the first aspect of the present invention, wherein a pair of third radiation elements disposed on an end portion of the second radiation element in a direction that the second element extends (for example, third radiation conductors 23*b*, 23*b* in the embodiment) and the pair of third radiation elements branching in horizontal and different directions from each other is so that the second and third radiation elements of the antenna element form substantially a T-shape.

According to the on-board antenna constructed as described above, by providing the pair of third radiation element portions which branch in the horizontal and different directions from each other at the end portion of the second radiation element portion, the dimension in the vertical direction of the antenna element aimed at a radio wave at a desired frequency band can be decreased.

Thus, in the event that for example, the first dielectric substrate is an automotive window glass with the antenna element being disposed on a passenger compartment side of the window glass, the deterioration in vehicle installation property can be suppressed.

According to third and fourth aspects of the present invention, wherein the grounding conductor has a notched portion (for example, a second notched portion 21*b* in the embodiment) in an outer edge portion thereof.

According to the on-board antenna constructed as described above, the reflection and waveguide properties thereof relative to vertical polarization can be improved.

According to sixth and seventh aspects of the present invention, further comprising a second dielectric substrate disposed on the first dielectric substrate so as to be substantially perpendicular thereto. wherein the second and/or third radiation element is disposed on the second dielectric substrate.

According to an eighth aspect of the present invention, the radiation element may be a semiconductor.

DETAILED DESCRIPTION OF THE PREFERRED EMBODIMENTS

Figure 1:
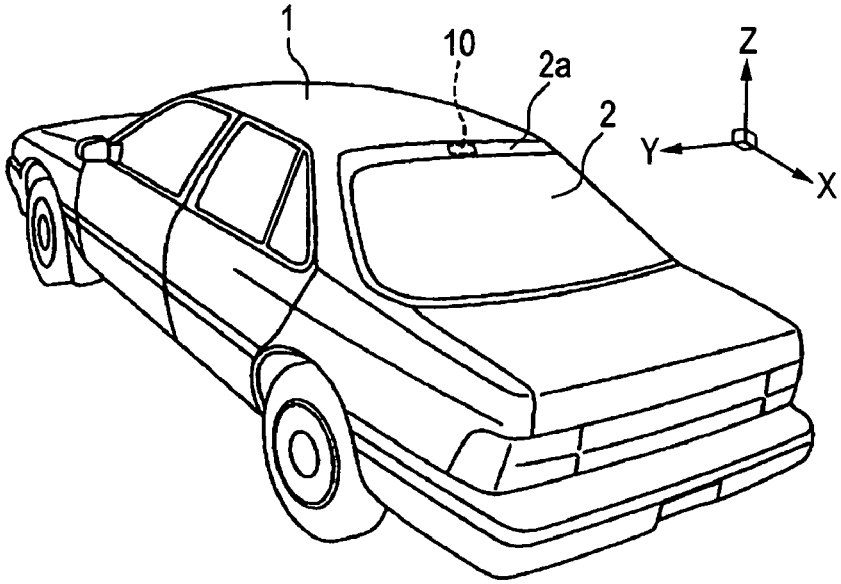
FIG. 1 is a perspective view of a vehicle on which an on-board antenna according to an embodiment of the present invention is installed.
Figure 2:
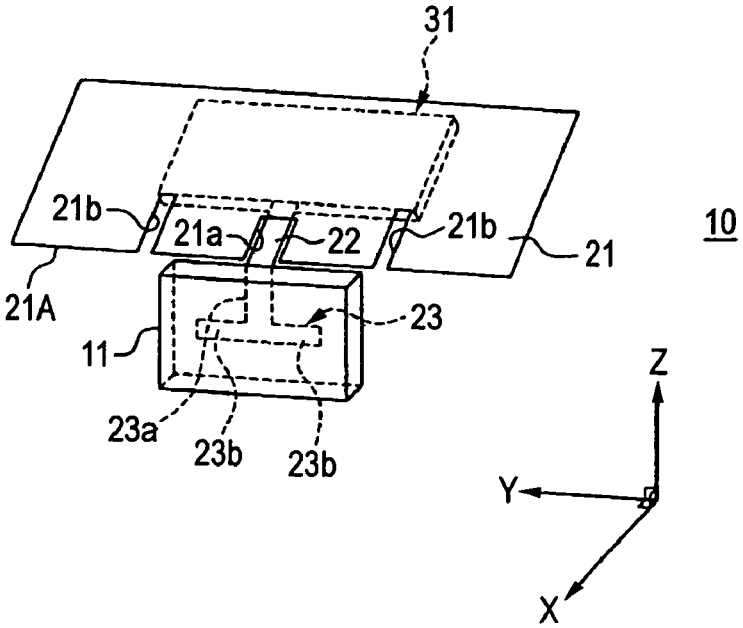
FIG. 2 is a perspective view of the on-board antenna shown in FIG. 1.

Referring to the accompanying drawings, an embodiment of an on-board antenna of the present invention will be described below.

An on-board antenna 10 according an embodiment of the present invention is, as shown in FIGS. 1 to 4, for example, disposed on a passenger compartment-side inner surface 2A of a peripheral edge portion 2*a* of a rear window glass 2, for example, of window glasses of a vehicle 1 and a surface 11A of a protruding dielectric substrate 11 which protrudes from the passenger compartment-side inner surface 2A substantially downwardly in the vertical direction on the passenger compartment side.

Then, this on-board antenna 10 is made to be an antenna for receiving radio waves, in particular, vertical polarization transmitted from an appropriate base station.

The on-board antenna 10 includes a grounding conductor 21 and a first radiation conductor 22 which are formed of conductive films disposed on the passenger compartment-side inner surface 2A of the rear window glass 2 which is made to function as a dielectric substrate and a vertical radiation conductor 23 disposed on the surface 11A of the protruding dielectric substrate 11 in such a manner as to extend from the first radiation conductor 22.

The grounding conductor 21 is formed into a substantially rectangular conductive film, and is connected to an appropriate ground wire (not shown) so as to be grounded at all times, and an amplifying circuit 31 is disposed at a vertically upper portion on the surface of the grounding conductor 21 disposed on the passenger compartment-side inner surface 2A which is inclined to form a downward slope toward the rear of the vehicle. This amplifying circuit 31 is disposed on an appropriate position on the grounding conductor 21.

Then, a first notched portion 21*a* extending toward the interior of the grounding conductor 21 is provided in an outer edge portion 21A at a vertically lower portion of the grounding conductor 21, and the first radiation conductor 22 which is formed of the substantially rectangular conductive film, for example, is disposed within this first notched portion 21*a*.

In addition, two second notched portions 21*b*, 21*b* extending toward the interior of the grounding conductor 21 are disposed in the outer edge portion 21A at the vertically lower portion of the grounding conductor 21 at positions spaced away from the first notched portion 21*a* so as to hold the first notched portion 21*a* from both sides thereof, whereby the reflection and waveguide properties thereof relative to vertical polarization are improved.

Then, the first radiation conductor 22 is connected to an appropriate feeding wire (not shown) at a feeding point 22*a* so that an appropriate high-frequency electric current conducts thereto and is also connected to the amplifying circuit 31 at the feeding point 22*a*.

Note that the amplifying circuit 31 amplifies a radio wave received thereby and then transmits a signal to a receiver (not shown).

The protruding dielectric substrate 11 is disposed so as to protrude from the passenger compartment-side inner surface 2A substantially vertically downwardly on the passenger compartment side at a position spaced away by an appropriate distance from an outer edge portion 21A at a vertically lower portion of the grounding conductor 21.

The vertical radiation conductor 23, which is connected to the first radiation conductor 22 and which includes a conductive film disposed on the surface 11A of the protruding dielectric substrate 11, includes, for example, a second radiation conductor 23*a* which extends substantially vertically downwardly and a pair of third radiation conductors 23*b*, 23*b* which branch in substantially horizontal and different directions from each other at a vertically downward end portion of the second radiation conductor 23*a* and is hence formed into substantially a T-shape.

Here, the length La of the second radiation conductor 23*a* which extends vertically downwardly and the respective lengths Lb, Lb in the substantially horizontal direction of the pair of third radiation conductors 23*b*, 23 are set to appropriate values based on a wavelength λ according to the resonant frequency of a radio wave to be transmitted and received.

Figure 3:
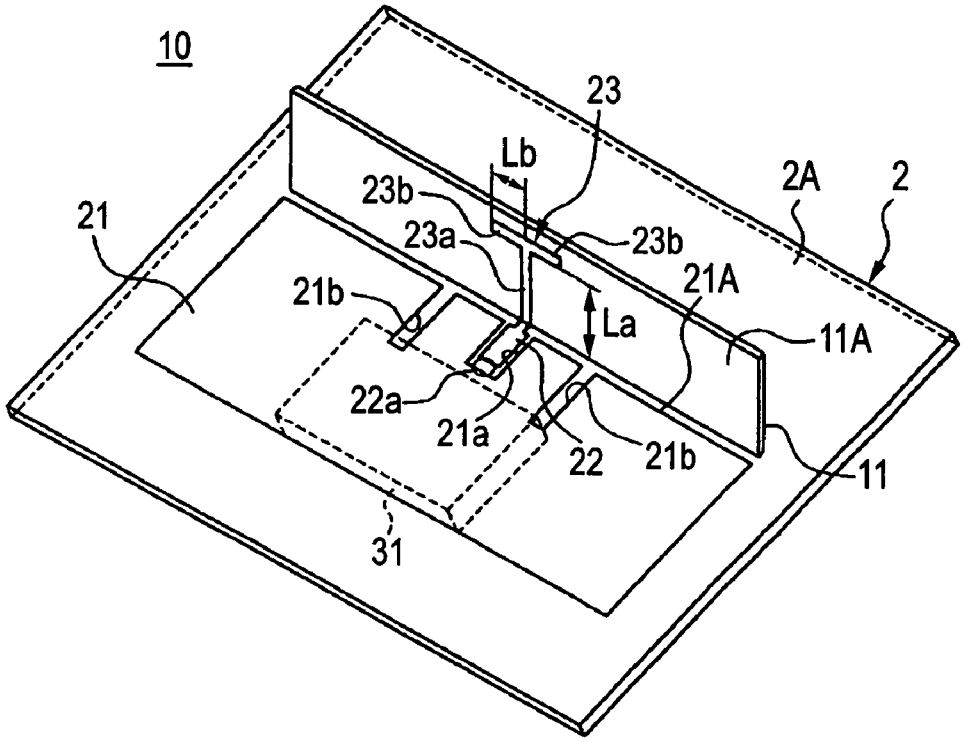
FIG. 3 is a perspective view of the on-board antenna shown in FIG. 1.
Figure 4:
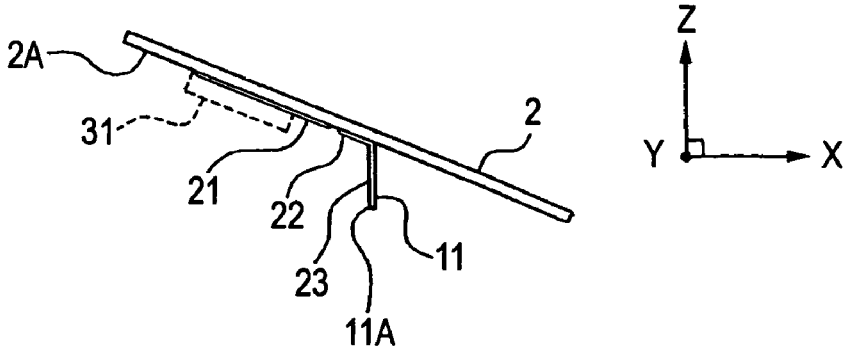
FIG. 4 is a cross-sectional view of the on-board antenna shown in FIG. 1.

A sum of the length La of the second radiation conductor 23*a* and the respective lengths Lb, Lb of the third radiation conductors 23*b*, 23 which are shown in FIG. 3, for example, is set to become about λ/4, so that the second radiation conductor 23*a* and the pair of third radiation conductors 23*b*, 23*b* which are formed substantially into a T-shape are put in a resonant condition by desired radio waves transmitted and received, whereby radiation and reception with a maximum power can be attained.

Figure 5:
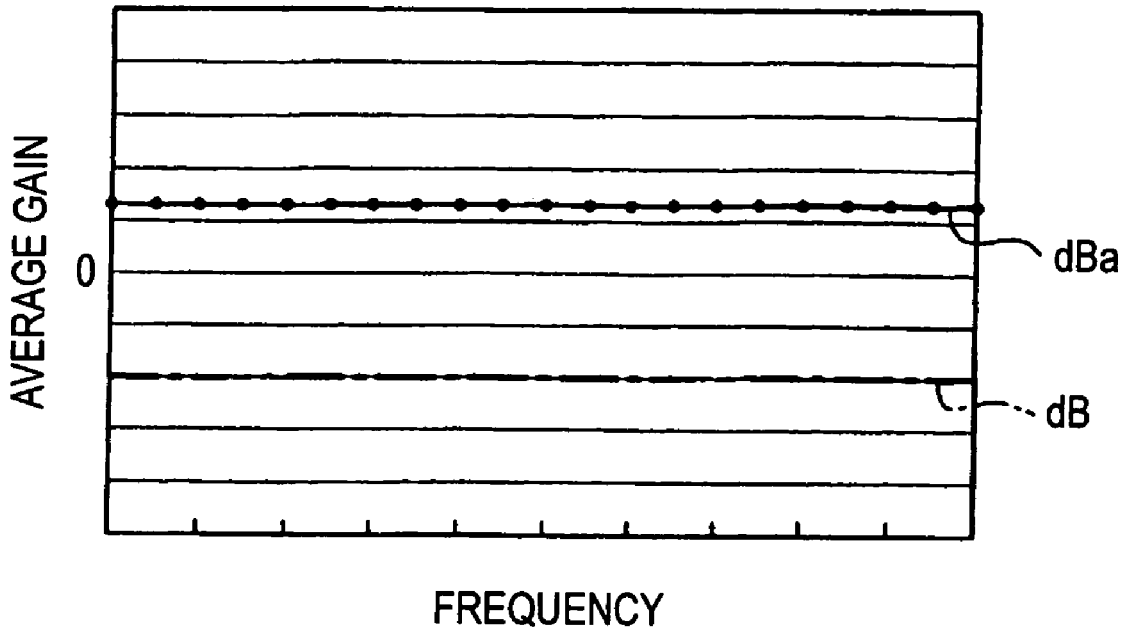
FIG. 5 is a graph illustrating one example of a change according to frequency in average gain of the on-board antenna shown in FIG. 1.

It is recognized that a change in sensitivity or gain relative to vertical polarization of the on-board antenna 10 according the frequency of an average value (average gain) dBa around a vertical axis (a Z axis shown in FIG. 1) becomes, for example, as shown in FIG. 5, a value larger than a predetermined lower limit average gain dB, whereby a desired transmitting and receiving sensitivity can be secured.

As has been described heretofore, according to the on-board antenna 10 of the embodiment of the present invention, the sensitivity relative to vertical polarization can be improved by providing the vertical radiation conductor 23 which extends substantially vertically.

Moreover, the substantially vertical length of the vertical radiation conductor 23 aimed at transmitting and receiving a radio wave with a desired frequency band can be decreased by forming the vertical radiation conductor 23 substantially into the T-shape, and even in the event that the vertical radiation conductor 23 protrudes on the passenger compartment side, the deterioration in vehicle installation property can be suppressed.

Furthermore, the reflection and waveguide properties relative to vertical polarization can be improved by providing the second notched portions 21*b*, 21*b* in the outer edge portion 21A of the radiation conductor 21.

In addition, the installation strength of the vertical radiation conductor 23 can be improved by allowing the vertical radiation conductor 23 to protrude from the passenger compartment-side inner surface 2A by the protruding dielectric substrate 11 when compared with a case, for example, where only the vertical radiation conductor 23 is caused to protrude from the passenger compartment-side inner surface 2A of the rear window glass 2.

Note that while, in the embodiment, the vertical radiation conductor 23 is formed substantially into the T-shape, the present invention is not limited thereto, the vertical radiation conductor may be formed substantially into an I-shape with the pair of third radiation conductors 23*b*, 23*b* being omitted, for example, according to the resonant frequency of a radio wave to be transmitted and received.

In this case, with the second radiation conductor 23*a* being put in a resonant condition relative to a radio wave having a wavelength λ which makes the length La of, for example, the second radiation conductor 23*a* to become λ/4, radiation and reception with a maximum power can be attained.

Note that while, in the embodiment, two second notched portions 21*b*, 21*b* are provided in the grounding conductor 21, the present invention is not limited thereto, and the second notched portions 21*b*, 21*b* may be omitted.

Note that while, in the embodiment, the on-board antenna 10 is made to include the respective radiation conductors 22, 23 which are formed of the conductive films, the present invention is not limited thereto, and a radiation element formed of a semiconductor may be provided in place of the respective radiation conductor 22, 23, for example.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

As has been described heretofore, according to the on-board antenna as set forth in the first aspect of the present invention, in the event that for example, the dielectric substrate is an automotive window glass, which has a surface which intersects a vertical direction, the sensitivity relative to vertical polarization can be improved by providing the second radiation element which extends substantially in the vertical direction.

According to the on-board antenna as set forth in the second aspect of the present invention, by providing additionally the pair of third radiation element portions the dimension in the vertical direction of the antenna element aimed at a radio wave at a desired frequency band can be decreased, and in the event that, for example, the dielectric substrate is an automotive window glass with the antenna element being disposed on a passenger compartment side of the window glass, the deterioration in vehicle installation property can be suppressed.

Furthermore, according to the on-board antenna as set forth in the third aspect of the present invention, the reflection and waveguide properties relative to vertical polarization can be improved.

What is claimed is:

1. An on-board antenna comprising:

a grounding conductor provided on a surface of a first dielectric substrate; and an antenna element including:

a first radiation element provided on the surface of the first dielectric substrate; and a second radiation element provided on the first radiation element so as to protrude from a surface of the first dielectric substrate and extend in a vertical directions wherein the first radiation element and the grounding conductor are provided on the same surface of the dielectric substrate.

2. An on-board antenna as set forth in claim 1, the antenna element further including:

a pair of third radiation element disposed on an end portion of the second radiation element in a direction that the second radiation element extends, the pair of third radiation element branching in horizontal and different directions from each other so that the second and third radiation elements of the antenna element form a T-shape.

3. An on-board antenna as set forth in claim 2, wherein the grounding conductor has a notched portion in an outer edge portion thereof.

4. An on-board antenna as set forth in claim 2, further comprising:

a second dielectric substrate disposed on the first dielectric substrate so as to be substantially perpendicular thereto wherein the second and the third radiation elements are disposed on the second dielectric substrate.

5. An on-board antenna as set forth in claim 1, wherein the grounding conductor has a notched portion in an outer edge portion thereof.

6. An on-board antenna as set forth in claim 1, wherein the second radiation element of the antenna element is an I-shape.

7. An on-board antenna as set forth in claim 1, further comprising:

a second dielectric substrate disposed on the first dielectric substrate so as to be substantially perpendicular thereto wherein the second radiation element is disposed on the second dielectric substrate.

8. An on-board antenna as set forth in claim 1, wherein the first and second radiation elements are a semiconductor.

* * * * *